US008364067B2

(12) United States Patent
Miki et al.

(10) Patent No.: US 8,364,067 B2
(45) Date of Patent: Jan. 29, 2013

(54) IMAGE HEATING APPARATUS

(75) Inventors: Tsutomu Miki, Kawasaki (JP); Kazuhisa Kemmochi, Suntou-gun (JP); Kenichi Ogawa, Kawasaki (JP); Satoshi Nishida, Numazu (JP); Masashi Tanaka, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 454 days.

(21) Appl. No.: 12/625,784

(22) Filed: Nov. 25, 2009

(65) Prior Publication Data

US 2010/0135706 A1 Jun. 3, 2010

(30) Foreign Application Priority Data

Nov. 28, 2008 (JP) ..... 2008-304022

(51) Int. Cl.
*G03G 15/20* (2006.01)

(52) U.S. Cl. ..... 399/328; 399/330; 399/329

(58) Field of Classification Search ..... 399/122, 399/320, 328–330
See application file for complete search history.

(56) References Cited

U.S. PATENT DOCUMENTS

| | | | | |
|---|---|---|---|---|
| 6,763,205 | B2 | 7/2004 | Izawa et al. | |
| 7,206,541 | B2 | 4/2007 | Fukita et al. | |
| 7,224,922 | B2 | 5/2007 | Kemmochi | |
| 7,251,427 | B2 | 7/2007 | Nanataki et al. | |
| 7,504,605 | B2 | 3/2009 | Nanataki et al. | |
| 7,630,677 | B2 | 12/2009 | Osada et al. | |
| 7,650,105 | B2 | 1/2010 | Ogawa et al. | |
| 7,734,241 | B2 * | 6/2010 | Nishida et al. | 399/333 |
| 2008/0050156 | A1 | 2/2008 | Yamanouchi et al. | |
| 2008/0273904 | A1 | 11/2008 | Nishida et al. | |
| 2008/0298863 | A1 | 12/2008 | Nanataki et al. | |
| 2009/0208264 | A1 * | 8/2009 | Fujiwara et al. | 399/329 |

FOREIGN PATENT DOCUMENTS

| | | |
|---|---|---|
| JP | 2003-186327 | 7/2003 |
| JP | 2003-295654 | 10/2003 |
| JP | 2003-295683 | 10/2003 |
| JP | 2003-302865 | 10/2003 |
| JP | 2004-145190 | 5/2004 |
| JP | 2004-253177 | 9/2004 |
| JP | 2004-279857 | 10/2004 |
| JP | 2006-078578 | 3/2006 |
| JP | 2006-084805 | 3/2006 |
| JP | 2007-304414 | 11/2007 |

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An image heating apparatus includes a rotatable member; a heater contactable to a surface of the rotatable member to heat the rotatable member; and a back-up member cooperative with the rotatable member to form a nip for nipping and feeding a recording material carrying an image, wherein a position of a peak in a pressure distribution with respect to a rotational direction of the rotatable member is upstream, with respect to the rotational direction, of a central portion of a contact region between the rotatable member and the heater with respect to the rotational direction.

16 Claims, 8 Drawing Sheets

IMAGE HEATING APPARATUS

FIELD OF THE INVENTION AND RELATED ART

The present invention relates to an image heating apparatus which is suitable to be used as a fixing apparatus (fixing device) to be mounted in an image forming apparatus, such as an electrophotographic copying machine, an electrophotographic printer, etc.

There have been known various fixing apparatuses to be mounted in an electrophotographic copying machine, an electrophotographic printer, and the like. One of them that is known is a fixing apparatus, which employs a fixing member and an external member for heating the fixing member. A fixing apparatus of this type has: a heating member (heater or the like); a fixation roller, which is heated by the heating member; and a pressure roller, which is placed in contact with the fixation roller to form a fixation nip. The fixing apparatus disclosed in Japanese Laid-open Patent Application 2003-186327 is of this type. In the case of this type of fixing apparatus, a recording medium sheet, which is bearing an unfixed toner image, is conveyed through the fixation nip in such a manner that the toner image-bearing surface of the recording medium faces the fixation roller. While the recording medium sheet is conveyed through the fixation nip, the sheet and the toner image thereon are heated. As a result, the toner image on the recording medium sheet becomes thermally fixed to the recording medium sheet.

Fixing apparatuses having an external heating member for heating a fixing member can be roughly classified into two types, that is, a contact type and a noncontact type. A fixing apparatus of the contact type places its heating member in contact with the peripheral surface of its fixation roller, whereas a fixing apparatus of the noncontact type heats the peripheral surface of its fixation roller with the use a halogen heater or the like, which is not placed in contact with the peripheral surface. In the case of a fixing apparatus of the contact type, the heat from a heating member, such as a ceramic heater, is directly placed in contact with the peripheral surface of the fixation roller to transmit the heat to the fixation roller. Therefore, a fixing apparatus of this type is higher in heat conduction efficiency than a fixing apparatus of the noncontact type.

It is reasonable to think that fixing apparatuses (devices) of the contact type, which employ an externally heated fixing member, can be classified into two types: a type, the heater of which is directly in contact with its fixation roller, and a type, which has a movable heating film which is kept pinched between the heater and fixation roller. In the case of a fixing apparatus having a movable heating film, the heater does not make direct contact with the fixation roller. Therefore, the offset toner, that is, the toner that remains adhered to the peripheral surface of the fixing member after toner image transfer, is unlikely to accumulate on the peripheral surface of the heater. In other words, a fixing apparatus having a movable heating film has the advantage that its heater is unlikely to be soiled. On the other hand, a fixing apparatus, the heater of which is directly in contact with its fixation roller has the advantage that it has a smaller the heat conductance resistance between the heater and the fixation roller, being therefore higher in thermal efficiency, than a fixing apparatus having a movable heating film.

A conventional fixing apparatus, which does not have a movable fixing film, and the fixing member of which is externally heated, is structured so that the peripheral surface of the fixation roller slides on the heating member for externally heating the peripheral surface of the fixation roller. Therefore, the peripheral surface of the fixation roller of a conventional fixing apparatus of this type is likely to be scarred.

The reason why the peripheral surface of the fixation roller is scarred is that foreign substances, such as sand, paper dust, etc., enter the area of contact (which hereafter may be referred to simply as "contact area") between the heater and the peripheral surface of the fixation roller.

As a result of the peripheral surface of the fixation roller becoming scarred by the foreign substances having entered the area of contact between the heater and the peripheral surface of the fixation roller as described above, the following problem occurs: The pattern of the scar is transferred onto the toner image on a recording medium sheet, making the toner image unsatisfactory, while the toner image on the recording medium sheet becomes fixed. For example, if the scar on the fixation roller is deep and/or wide, a copy of an original image having vertical stripes which are not on the original image is produced.

SUMMARY OF THE INVENTION

The present invention was made in consideration of the above-described problems, and its primary object is to provide an image heating apparatus which is capable of preventing its heater from being scarred.

Another object of the present invention is to provide an image heating apparatus structured so that foreign substances are unlikely to enter the area of contact between its fixing member and heater.

Another object of the present invention is to provide an image heating apparatus, the fixing member of which is not scarred even if foreign substances enter the area of contact between its fixing member and heater.

According to an aspect of the present invention, there is provided an image heating apparatus comprising a rotatable member; a heater contactable to a surface of the rotatable member to heat the rotatable member; and a back-up member cooperative with the rotatable member to form a nip for nipping and feeding a recording material carrying an image, wherein a position of a peak in a pressure distribution with respect to a rotational direction of the rotatable member is upstream, with respect to the rotational direction, of a central portion of a contact region between the rotatable member and the heater with respect to the rotational direction.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

(1) Example of Image Forming Apparatus

Figure 15:
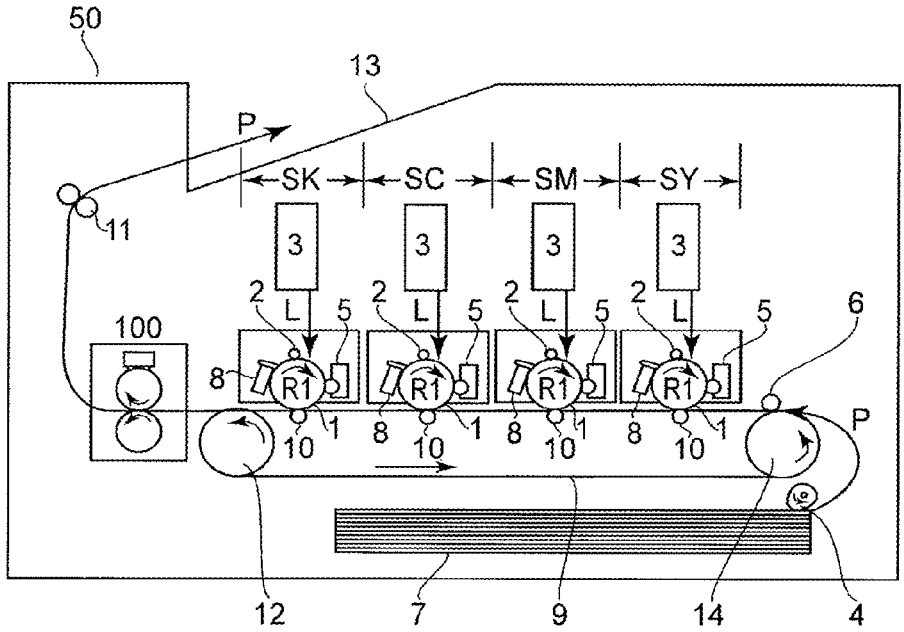
FIG. 15 is a schematic sectional drawing of an example of image forming apparatus in accordance with the present invention.

FIG. 15 is a schematic sectional drawing of an example of image forming apparatus in which an image fixing apparatus in accordance with the present invention is mounted as a fixing apparatus (fixing device). This image forming apparatus is an electrophotographic full-color laser printer.

The image forming apparatus 50 in the first preferred embodiment of the present invention has four (first to fourth) image formation stations SY, SM, SC, and SK, which form toner images of yellow, magenta, cyan, and black colors, respectively. Each of the image formation stations SY, SM, SC, and SK has an electrophotographic photosensitive member 1, as an image bearing member, which is in the form of a drum (and therefore, will be referred to as a photosensitive drum, hereafter). Each image formation station has a charging device 2, an exposing apparatus 3, a developing device 5, and a drum cleaner 8, which are in the adjacencies of the peripheral surface of the photosensitive drum 1, and are in the listed order in terms of the rotational direction (direction indicated by arrow mark R1) of the photosensitive drum 1. The image forming apparatus 50 has an endless recording medium conveyance belt 9, as a recording medium conveying means, which faces the peripheral surface of the photosensitive drum 1 of each of the image formation stations SY, SM, SC and SK. The recording medium conveyance belt 9 is on two rotational members, that is, a driver roller 12 and a tension roller 14, by being wrapped around the two rollers 12 and 14. They are of a dielectric resin, being enabled to electrostatically hold the recording medium conveyance belt 9. The image forming apparatus 50 has four transfer rollers 10 as a transferring means. Each transfer roller 10 opposes the peripheral surface of the photosensitive drum 1 in the image formation station SY, SM, SC or SK, in such a manner that the recording medium conveyance belt 9 remains pinched between the transfer roller 10 and photosensitive drum 1. The interface between the peripheral surface of the photosensitive drum 1 and the recording medium transfer belt 9 is the transfer portion.

The image forming apparatus 50 in this embodiment carries out a preset image formation sequence (image forming operation), in response to a print signal, which is outputted from an external apparatus (unshown), such as a host computer. More concretely, each photosensitive drum 1 is rotated in the direction indicated by the arrow mark, at a preset peripheral velocity (process speed). Further, the recording medium conveyance belt 9 is circularly moved in the direction indicated by an arrow mark, at a peripheral velocity which matches the peripheral velocity of the photosensitive drum 1, by the rotational driving of the driver roller 12.

First, in the first image formation station, that is, the yellow image formation station SY, the peripheral surface of the photosensitive drum 1 is uniformly charged to a preset polarity and potential level by the charging device 2. In the first preferred embodiment, the peripheral surface of the photosensitive drum 1 is charged to the negative polarity. Then, the charged portion of the peripheral surface of the photosensitive drum 1 is exposed, and the charged portion of the peripheral surface of the photosensitive drum 1 is scanned with a beam of laser light L projected from the exposing apparatus 3 in response to the image information from the external apparatus. As a result, an electrostatic latent image, which reflects the image information, is formed on the charged portion of the peripheral surface of the photosensitive drum 1. This electrostatic latent image on the peripheral surface of the photosensitive drum 1 is developed by the developing device 3, with yellow toner (developer); the electrostatic latent image is turned into a visible image formed of toner (developer) (which hereafter will be referred to as toner image (developer image)). The charging, exposing, and developing processes, which are similar to those carried out in the first (yellow) image formation station SY, are carried out in the magenta (second color) image formation station SM, the cyan (third color) image formation station SC, and the black (fourth color) image formation station SK. In other words, in each of the image formation stations SY, SM, SC, and SK, a toner image (developer image), which is different in color from the toner images in other image formation stations, is formed on the peripheral surface of the photosensitive drum 1.

Meanwhile, the recording medium sheets P, which are in layers in a recording medium sheet feeder cassette 7, are sent out of the sheet feeder cassette 7, one by one, by a feed roller 4. Then, each recording medium sheet P is charged by an adhesion roller 6, to which a positive bias is being applied. Thus, the recording medium sheet P remains held to the recording medium conveyance belt 9 by being electrostatically adhered to the outward surface of the recording medium conveyance belt 9. Then, the recording medium sheet P is conveyed by the circular movement of the recording medium conveyance belt 9, from the upstream side of the most upstream transfer portion, in terms of the circular movement direction of the recording medium conveyance belt 9, to the downstream side of the most downstream transfer portion. While the recording medium sheet P is conveyed as described above, a transfer bias, which is opposite in polarity to the toner image, is applied to the transfer roller 10 of each of the image formation stations SY, SM, SC, and SK. By this transfer bias, each transfer roller 10 transfers the toner image on the peripheral surface of the corresponding photosensitive drum 1, onto the surface of the recording medium sheet P. Therefore, four toner images, different in color, are sequentially layered on the recording medium sheet P. Thus, an unfixed full-color toner image is formed, and borne, on the recording medium sheet P.

The recording medium sheet P, which bears the unfixed full-color toner image, is conveyed by the recording medium conveyance belt 9 to the fixing apparatus 100 (fixing device). Then, the recording medium sheet P is conveyed through the fixation nip N of the fixing apparatus 100 which will be described later. While the recording medium sheet P is conveyed through the fixation nip N, the unfixed toner image on the recording medium sheet P is thermally fixed to the surface of the recording medium sheet P. After the fixation of the toner image, the recording medium sheet P is discharged by a pair of discharge rollers 11 onto a delivery tray 13.

The transfer residual toner, which is the toner remaining on the peripheral surface of the photosensitive drum 1 after the toner image transfer, is removed and recovered by the drum cleaner 8.

(2) Fixating Apparatus (Image Heating Apparatus)

In the following description of the fixing apparatus 100, the lengthwise direction of the fixing apparatus 100 and that of the structural components of the fixing apparatus 100 are the directions which are perpendicular to the recording medium conveyance direction, on the surface of the recording medium sheet P. The widthwise (shorter) direction of the recording medium sheet P is the direction which is parallel to the recording medium conveyance direction, on the surface of the recording medium sheet P. That is, the length of the fixing apparatus, or any of the components of the fixing apparatus, is the measurement of the fixing apparatus, or any of the components of the fixing apparatus, in terms of the lengthwise direction, and the width of the fixing apparatus, or any of the components of the fixing apparatus, is the measurement of the fixing apparatus, or any components of the fixing apparatus, in terms of the widthwise (shorter) direction.

Figure 1:
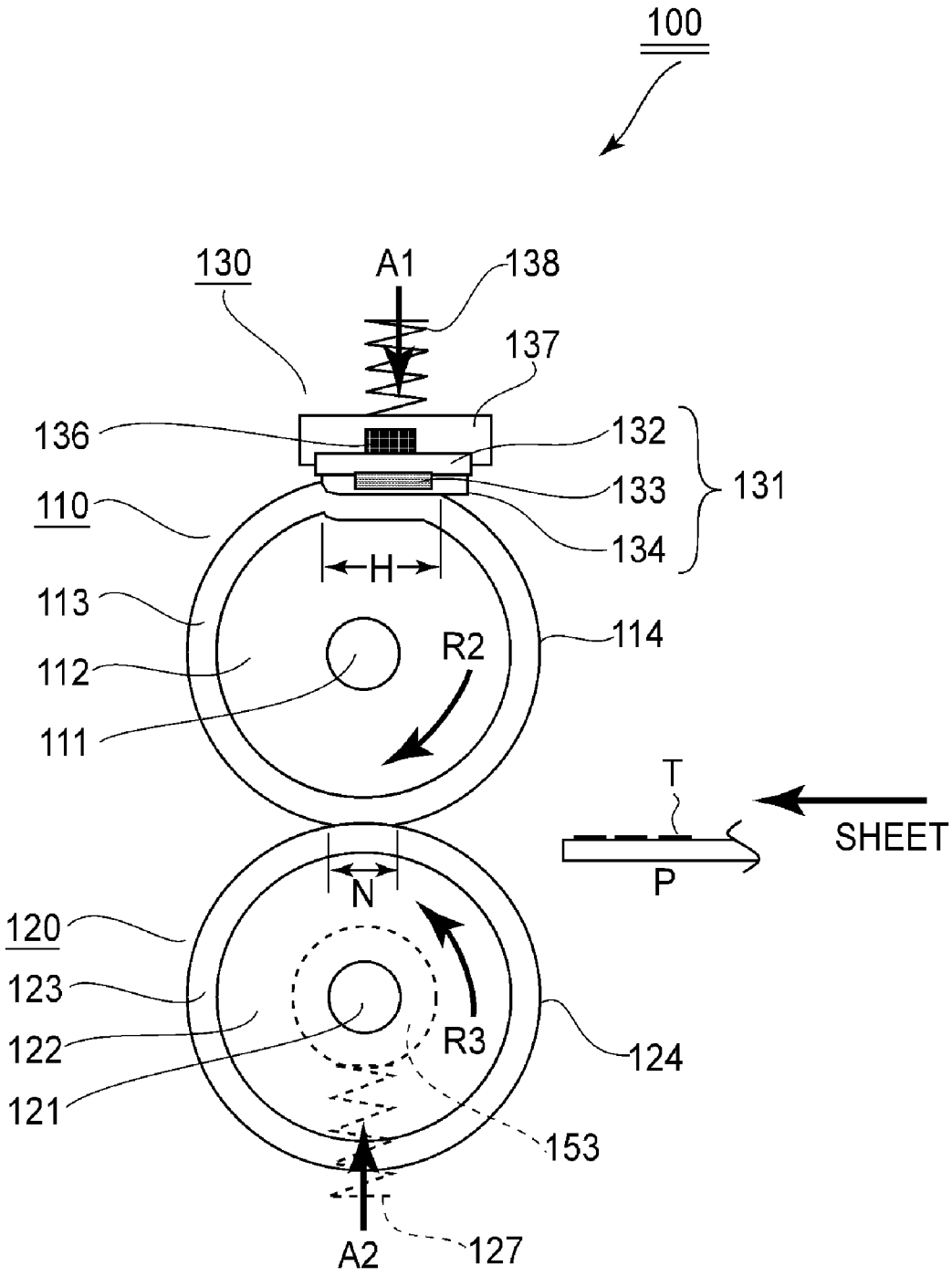
FIG. 1 is a schematic sectional drawing of the fixing apparatus, in the first preferred embodiment.
Figure 2:
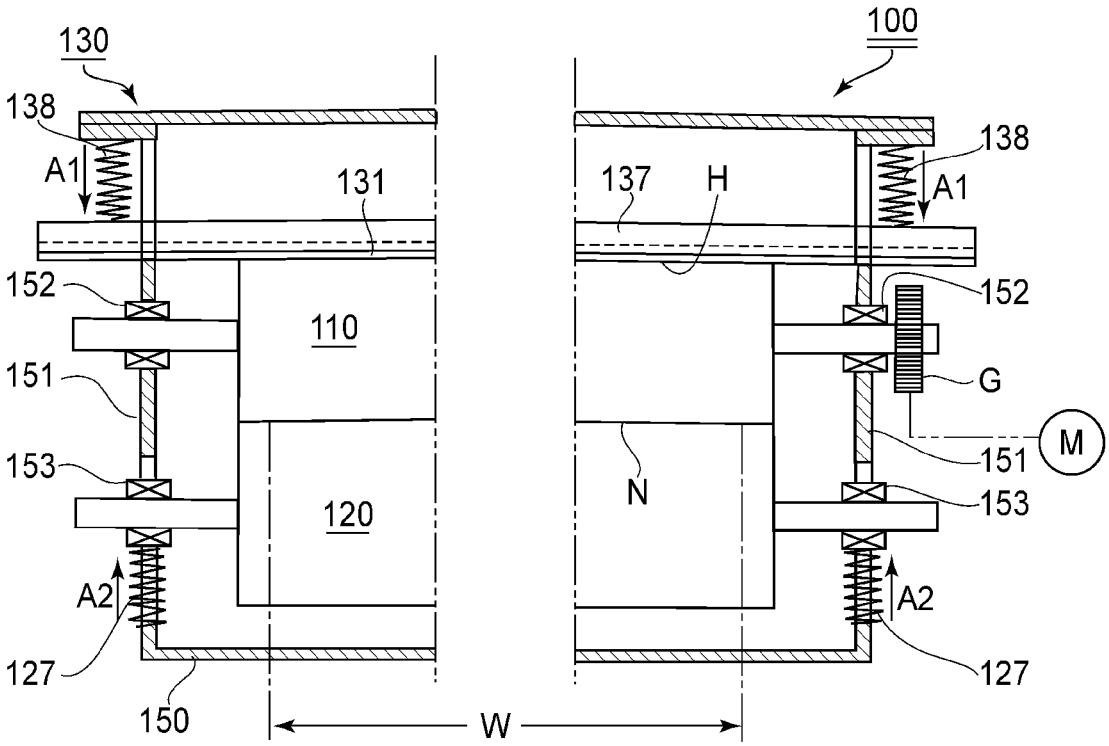
FIG. 2 is a schematic sectional drawing of the fixing apparatus, in the first preferred embodiment, at a plane parallel to the lengthwise direction of the fixing apparatus (center portion of which is not shown).

FIG. 1 is a schematic sectional drawing of the fixing apparatus 100. FIG. 2 is a front view of the fixing apparatus 100. FIG. 2 does not show the center portion of the fixing apparatus 100 in terms of the lengthwise direction. The fixing apparatus 100 is structured so that its fixation roller is externally heated. Thus, as the fixation roller is rotated, the fixation roller and heating member slide on each other.

The fixing apparatus 100 in this preferred embodiment has a fixation roller 110 (rotatable member), a pressure roller 120 (backup member), and a heater unit 130. The fixing apparatus 100 is structured so that the peripheral surface of the pressure roller 120 is kept in contact with the peripheral surface of the fixation roller 110. The interface between the two rollers 120 and 110 is the fixation nip N. The heater unit 130 has a ceramic heater 131 (heating member), and a heater holder 137 (which holds heater 131). The heater 131 is positioned so that it remains in contact with the peripheral surface of the fixation roller 110, at a different location from the fixation nip N. The interface between the heater 131 and fixation roller 110 is the contact area H. The fixation roller 110, the pressure roller 120, the heater 131, and the heater holder 137 are all long and narrow components, the lengthwise direction which coincides with that of the fixing apparatus 100.

(2-1) Description of Fixation Roller

Basically, the fixation roller 110 is made up of a metallic core 111 and an elastic layer 112. The metallic core 111 is a piece of round rod, and is formed of a metallic substance such as SUS (stainless steel), aluminum, or the like. Its peripheral surface is roughened by blasting or the like method. The elastic layer 112 is in the form of a roller, and is fitted around the peripheral surface of the metallic core 111.

If the elastic layer 12 is large in thermal capacity, and higher in thermal conductivity, and the heat which the peripheral surface of the elastic layer 112 receives from the external heat source is absorbed into the fixation roller, making it difficult for the fixation roller 110 to increase in surface temperature. Thus, the length of time it takes for the surface temperature of the fixation roller 110 to reach its operation temperature level can be reduced by forming the elastic layer 112 of a substance which is small in thermal capacity, low in thermal conductivity, and higher in adiabatic efficiency.

As the highly adiabatic substances which are usable as the material for the elastic layer 112, sponge made by foaming silicone rubber, sponge-like rubber made by dispersing hollow particles in silicone rubber, and the like, can be used.

The thermal conductivity of the rubber sponge and sponge-like rubber in this embodiment is in a range of 0.10-0.16 W/m, which is roughly half of the thermal conductivity of solid rubber, the thermal conductivity of which is in a range of 0.25-0.29 W/m. Further, in terms of specific gravity, to which thermal capacity is related, solid rubber is in a range of roughly 1.05-1.30, whereas, the rubber sponge and sponge-like rubber are in a range of roughly 0.75-0.85, which is substantially lower than that of solid rubber.

Therefore, the rubber sponge and sponge-like rubber, which are no higher than 0.15 W/m in thermal conductivity, and no higher than 0.85 in specific gravity, are preferable as the material for the elastic layer 112 of the fixation roller 110 to solid rubber.

The smaller the fixation roller 110 is in external diameter, the smaller its thermal capacity. However, the reduction in the external diameter of the fixation roller 110 results in the reduction in the width of the contact area H and the width of the fixation nip N. Thus, the fixation roller 110 has to be greater in external diameter than a certain value. Further, the thinner the elastic layer 112, the easier heat escapes to the metallic core. Therefore, the elastic layer 112 needs to be thicker than a certain value.

In this embodiment, therefore, in consideration of the above-described concerns, and in order to form the contact area H, which is proper in size, and also, in order to keep the fixation roller 110 low in thermal capacity, a fixation roller, the elastic layer of which is formed of 2 mm thick rubber sponge, and which is 14 mm in external diameter, was used as the fixation roller 110 for the heating apparatus 100 in this embodiment.

The fixation roller 110 has a heat storage layer 113 (formed of solid rubber), which is formed of silicon rubber, being therefore higher in thermal conductivity than the elastic layer 112, and having a certain amount of thermal capacity. The thermal conductivity and specific gravity of the heat storage layer 113 are in a range of 0.50 W/m·K-1.60 W/m·K, and in a range of roughly 1.05-1.30, respectively.

Reducing the heat storage layer 113 in thickness reduces it in thermal capacity, making it impossible for the heat storage layer 113 to supply the recording medium sheet P, such as paper, with a sufficient amount of heat. On the other hand, increasing the heat storage layer 113 in thickness enables the heat storage layer 113 to more effectively supply the recording medium sheet P with heat, but, it causes the heat storage layer 113 to store more heat than necessary. In other words, it reduces the heat storage layer 113 in efficiency, and also, increases the length of time necessary to warm up the fixing device. Thus, the desirable thickness for the heat storage layer 113 is in a range of 0.1-0.3 mm; the preferable thickness for the heat storage layer 113 is roughly 0.15 mm.

The fixation roller 113 has also a separation layer 114, which is for separating toner from the peripheral surface of the fixation roller 113. The separation layer 114 is formed of perfluoroalkoxy resin (PFA). The separation layer 114 may be in the form of a piece of tube, which wraps around the heat storage layer 113, or may be formed by coating the peripheral surface of the heat storage layer 113 with the perfluoroalkoxy resin. The separation layer 114 in this embodiment is in the form of a piece of tube, which is superior in durability.

As the material for the separation layer 114, a fluorinated resin, such as polytetrafluoroethylene resin (PFFE), tetrafluoroethylene-hexafluoropropylene resin (FEP), etc., may be used in addition to PFA. Further, the separation layer 114 may be formed by coating the peripheral surface of the heat storage layer 113 with GLS latex.

If the fixation roller 110 is low in surface hardness, the contact area H can be made wide enough by the application of a relatively small amount of pressure. However, if the fixation roller 110 is too small in surface hardness, it is lower in durability. Therefore, in this embodiment, the fixation roller 110 is formed so that its surface hardness is in a range of 40-45° in Asker-C (4.9 N load).

The fixation roller 110 is rotatably supported by supporting the lengthwise end portions of the metallic core 111 with a pair of lateral plates 151 of the apparatus frame 150, in such a manner that a pair of bearings 152 are placed between the pair of lateral plates 151, and the lengthwise end portions of the metallic core 111, one for one. The fixing apparatus 100 is structured so that as a driver gear G, with which one of the lengthwise ends of the metallic core 111 is provided, is rotationally driven by a fixation motor M (as driving force source), the fixation roller 110 rotates in the direction indicated by an arrow mark R2 at a peripheral velocity of 100 mm/sec.

(2-2) Description of Pressure Roller

In order to make it difficult for the pressure roller 120 to rob heat from the fixation roller 110, the pressure roller 120 is desired to be low in thermal capacity and thermal conductivity. The fixation pressure 120 in the first preferred embodiment is the same in structure as the fixation roller 110. That is, the pressure roller 120 is 14 mm in external diameter. It is made up of: a round metallic (steel) core 121; a 2 mm thick elastic layer 122 (rubber sponge) formed on the peripheral surface of the metallic core 121; a roughly 0.15 mm thick heat storage layer (solid rubber) formed on the peripheral surface of the elastic layer 122; and a separation layer 124 formed, as the outermost layer, on the peripheral surface of the heat storage layer 123.

The pressure roller 120 is under the fixation roller 110, and is in parallel to the fixation roller 110. The lengthwise end portions of the metallic core 121 are rotatably held by the pair of lateral plates 151, with the interposition of a pair of bearings 153 between the lengthwise end portions of the metallic core 121 and the pair of lateral plates 151, one for one. Each bearings 153 is kept pressured upward (indicated by arrow mark A2) by a pressure application spring 127 (pressure applying member) which generates 2.2 N of upward pressure. Therefore, the peripheral surface of the pressure roller 120 remains in contact with the peripheral surface of the fixation roller 110. The pressure from the pair of springs 127 keeps the elastic layer 122 of the pressure roller 120, and the elastic layer 112 of the fixation roller 110, elastically deformed, forming thereby the fixation nip N, which is 5 mm wide, between the peripheral surface of the pressure roller 111 and the peripheral surface of the fixation roller 110.

(2-3) Description of Heater Unit

Figure 3:
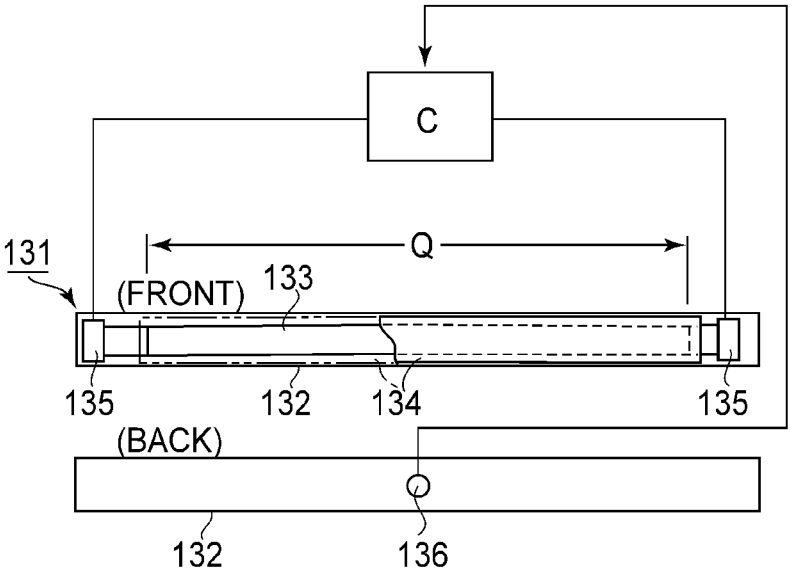
FIG. 3 is a schematic drawing of an example of the heater of the fixing apparatus, and shows the structure of the heater.

FIG. 3 is a schematic drawing of an example of heater, and shows the structure of the heater.

The heater 131 has: a substrate 132 which is in the form of a long and narrow plate; and a heat generation resistor 133 (which hereafter will be referred to as heat generating portion), which is on one of the primary surfaces of the substrate 132. More specifically, the heat generation resistor 133 is on the substrate surface which faces the fixation roller 110, and its lengthwise direction is parallel to the lengthwise direction of the substrate 132. The material of the substrate 132 is a dielectric ceramic (such as alumina, aluminum nitride, etc.), or a heat resistance resin (such as polyimide, PPS, liquid polymer, etc.). The heat generating portion 133 is formed using the following method: a paste made up of one of such materials as Ag/Pd (silver/palladium), RuO2, Ta2N, and the like, is placed on the substrate surface, which faces the fixation roller 110, in the preset pattern of the heat generating portion 133, by screen printing, and then, the combination of the substrate 132 and the patterned paste on the substrate 132 is sintered. The heat generating portion 133 is a linear member, being roughly 10 μm in thickness, roughly 1-5 mm in width, and roughly 300 mm in length. Each of the lengthwise ends of the heat generating portion 133 has an electrode 135 for supplying the heat generating portion 133 with electric power. The electrodes 135 are formed as integral parts of the heat generating portion 133. Further, the heat generating portion 133 is covered with a heating member protection layer 134, which is a glass layer and is 50 μm in thickness.

The material for the heater holder 137 is a heat resistance resin such as liquid polymer, phenol resin, PPS, PEEK, and the like. The lower the heater holder 137 in thermal conductivity, the higher the ratio with which the heat from the heat generating portion 133 is transmitted to the peripheral surface of the fixation roller 110. Therefore, the heater holder 137 may be formed of a resinous material in which hollow particles, such as glass balloons, silica balloons, or the like, have been dispersed.

The heater holder 137 holds the substrate 132 in such a manner that the glass layer 134 of the heater 131 faces the peripheral surface of the fixation roller 110, the lengthwise end portions of which are held by the pair of lateral plate 151. Further, the lengthwise end portions of the heater holder 137 are under the pressure applied thereto in the downward direction indicated by the arrow mark A1 by a pair compression springs 138 (pressure applying member. Therefore, the glass layer 134, which is the surface layer of the heater 131 remains in contact with the peripheral surface of the fixation roller 110. Thus, the elastic layer 112 of the fixation roller 110 remains elastically deformed by the pressure from the compression springs 138, providing the contact area H (with preset width) between the surface of the glass layer 134 and the peripheral surface of the fixation roller 110. In this embodiment, that is, the first preferred embodiment, the contact area H formed by applying 9.8 N of pressure to the lengthwise end portions of the heater holder 137 by the compression springs 138 is roughly 3 mm in width.

There is a temperature detection element 136 (temperature detecting member), such as a thermistor, for detecting the temperature of the heater 131 is on the back surface of the substrate 132, that is, the substrate surface opposite from the heat generating portion 133. The temperature detection element 136 is for controlling the temperature of the heater 131, or watching for the abnormal temperature increase of the heater 131.

(2-4) Description of Thermally Fixing Operation of Fixing Apparatus

The driving operation controlling portion (unshown) rotates the driver gear G by driving a fixation motor M (FIG. 2) in response to a printing signal. Thus, the fixation roller 110 rotates in the direction indicated by the arrow mark R2, at a peripheral velocity of 100 mm/sec. As the fixation roller 110 rotates, a rotational force which is opposite in direction from the rotational direction of the fixation roller 110, is applied to the pressure roller 120 by the friction between the peripheral surface of the fixation roller 110 and the peripheral surface of the pressure roller 120. Therefore, the pressure roller 120 follows the rotation of the fixation roller 110, rotating in the direction indicated by an arrow mark R3 at roughly the same peripheral velocity as that of the fixation roller 110 (FIG. 1).

Further, a temperature controlling portion C (FIG. 3) causes the flow of electricity through the heater 131 by way of the electrodes 135 of the heater 131. As a result, the heat generating portion 133 generates heat. Thus, the heater 131 quickly increases in temperature, and heats the peripheral surface of the fixation roller 110. The length Q (FIG. 3) of the heat generating portion 133 which generates heat as electricity flows through it, is slightly longer than the width W (in terms of the direction of the generatrix of the fixation roller) of the largest recording medium sheet P usable with the image forming apparatus. The temperature of the heater 131 is detected by the temperature detection element 136, which outputs a signal which indicates the detected temperature of the heater 131. The temperature controlling portion C takes in the signal outputted from the temperature detection element 136, and controls the amount of electricity sent to the heat generating portion 133, in order to keep the temperature of the heater 131 at the fixation temperature level (target temperature level). Therefore, the temperature of the heater 131 remains at a preset fixation temperature level. The heater 131 heats the peripheral surface of the fixation roller through the contact area H.

While the fixation roller 110 and the pressure roller 120 are kept stable in rotation, and also, the temperature of the heater 131 is kept at the preset fixation temperature level, the recording medium sheet P, which bears the unfixed toner image(s), is introduced into the fixation nip N in the recording medium conveyance direction, and is conveyed through the fixation nip N while remaining pinched by the peripheral surface of the fixation roller 110 and the peripheral surface of the pressure roller 120. While the recording medium sheet P is conveyed through the fixation nip N, the heat from the peripheral surface of the fixation roller 110 (which is being heated by heater 131), and the pressure in the fixation nip N are applied to the recording medium sheet P and the toner image(s) thereon. As a result, the toner image(s) T on the recording medium sheet P is thermally fixed to the surface of the recording medium sheet P by the heat and pressure.

In this embodiment (first preferred embodiment), the glass layer 134 of the heater 131 is kept directly in contact with the peripheral surface of the fixation roller 110. However, the heat generating portion 133 may be covered with an unshown layer which is excellent in separation and slipperiness, instead of the glass layer 134.

(2-5) Description of Pressure Distribution in Contact Area

Next, the position of the pressure peak of the pressure distribution of the contact area H, in terms of the rotational direction of the fixation roller 110, which characterizes the present invention, will be described regarding the fixating apparatus structure which places the pressure peak on the upstream side of the center (mid point) of the contact area H, in terms of the rotational direction of the fixation roller 110.

Figure 4:
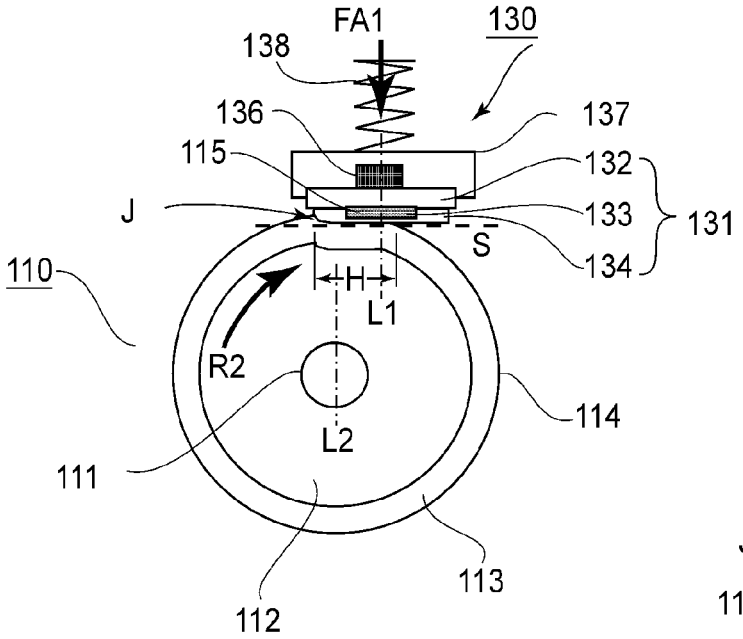
FIG. 4 is a schematic sectional drawing of the combination of the fixation roller and heater unit of the apparatus in the first preferred embodiment of the present invention, and is for describing the area of contact between the fixation roller and heater unit.
Figure 4A:
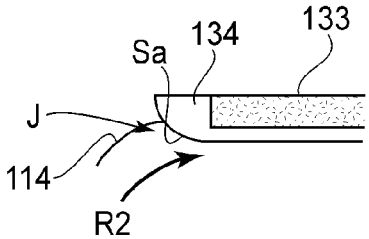
FIG. 4A is an enlarged view of a part of FIG. 4.

FIG. 4 is a drawing for describing the contact area H of the fixing apparatus 100 in this embodiment (first preferred embodiment). It is a schematic sectional drawing of the combination of the fixation roller 110 and heater unit 130.

Referring to FIG. 4, designated by reference characters L1 is the center line (which is perpendicular (normal) to the interface (which hereafter will be referred to as interface S) between the heater 131 of the heater unit 130, and the fixation roller 110, in terms of the width direction of the heater 131. Designated by a reference characters L2 is the center line of the rotational shaft of the fixation roller 110 (center line L2 is imaginary line which is parallel to center line L1). The center line L1 extends through the downstream half of the contact area H. Further, the upstream end J of the glass layer 134 of the heater 131, in terms of the rotational direction of the fixation roller 110, is within the contact area H, and is located very close to the point of intersection between the line L2 and interface S. That is, the peak value of the pressure distribution in the contact area H, in terms of the rotational direction of the fixation roller 110, is generated by the upstream end J of the glass layer 134, in terms of the rotational direction of the fixation roller 110, in the contact area H of the heater 131.

At this time, the contact area (H) of the comparative example of fixing apparatus will be described.

Figure 16:
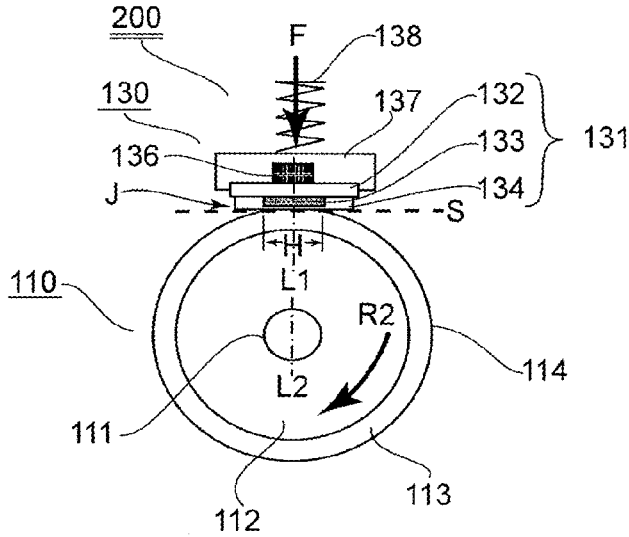
PRIOR ART FIG.16
FIG. 16 is a schematic sectional drawing of the combination of the fixation roller and the heater unit of an example of comparative fixing apparatus, and is for describing the area of contact between the fixation roller and the heater unit.

FIG. 16 is a drawing for describing the contact area (H) of the comparative example of fixing apparatus. It is a schematic sectional drawing of the combination of the fixation roller and heater unit of the comparative example of fixing apparatus. Incidentally, regarding the reference characters given to the various members, portions, etc., of the comparative example of fixing apparatus, the members, portions, etc., of the comparative example of fixing apparatus, which are the same as the counterparts of the fixing apparatus in the first preferred embodiment, are given the same reference characters as those given to the counterparts of the fixing apparatus in the first preferred embodiment, one for one.

In the case of the comparative fixing apparatus 200, the position at which the heater 131 compresses the fixation roller 110 by the largest amount, that is, the position at which the pressure is highest in the contact area H, is the point of intersection between the lines L1 and L2. Referring to FIG. 16, in the case of the comparative fixing apparatus 200, the line L1 and the line L2 virtually coincide with each other, and therefore, the pressure peak in the contact area H is roughly at the center of the contact area H.

Structuring a fixing apparatus so that the line L1 is on the downstream side of the line L2 in terms of the rotational direction of the fixation roller 110, as in the fixing apparatus 100 in this embodiment (first preferred embodiment), causes the point of intersection between the line L and interface S to be placed in the upstream portion of the contact area H, and therefore, the pressure peak of the contact area H is in the upstream portion of the contact area H. That is, the positional relationship between the substrate 132 and the fixation roller 110 is set so that the line (L1) which is normal to the substrate 132 of the heater 131 and extends through the center of the substrate 132, extends through the downstream portion of the contact area H in terms of the rotation direction of the fixation roller 110. Further, the upstream end J of the glass layer 134 of the heater 131 is within the contact area H. Therefore, if the upstream end J of the glass layer 134 is shaped so that the end surface of the upstream end J is straight and perpendicular to the primary surfaces of the glass layer 134, the separation layer 114 (surface layer) of the fixation roller 110 is likely to be scarred by the upstream end J of the glass layer 134. In this embodiment, therefore, in order to prevent the separation layer 114 of the fixation roller 110 from being damaged, the upstream end J of the glass layer 134 of the heater 131 is polished to round the rectangular edge of the upstream end J so that a curved surface Sa (FIG. 4: enlarged view of upstream end J) is created in a manner to connect the upstream end J to the upstream end of the interface S, which is at the recording medium entrance side of the contact area H.

Figure 5:
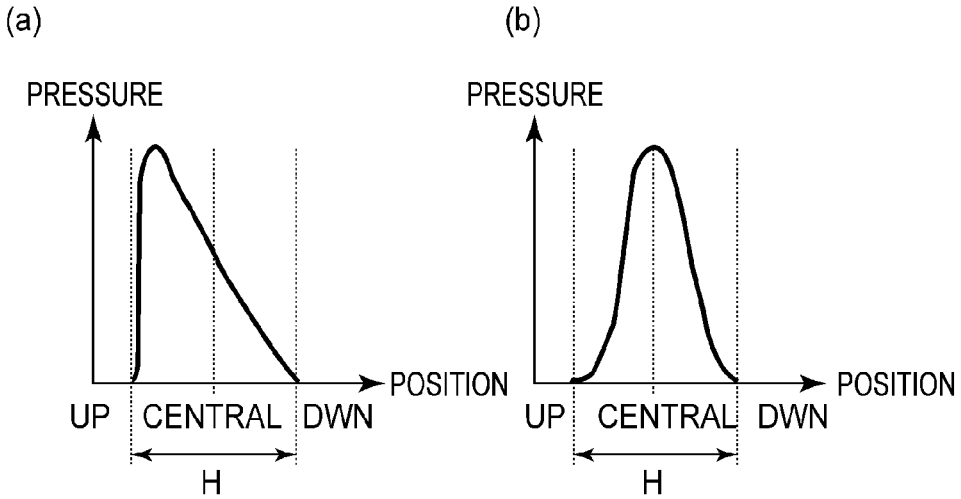
In FIG. 5, (*a*) is a diagrammatic drawing which shows the pressure distribution in the area of contact of the fixing apparatus, in terms of the rotational direction of the fixation roller, in the first preferred embodiment, and (*b*) is a diagrammatic drawing which shows the pressure distribution in the area of contact of one of the comparative examples of fixing apparatus, in terms of the rotational direction of the fixation roller.

Shown in FIG. 5(*a*) is the pressure distribution in the contact area H of the fixing apparatus 100 in this embodiment, in terms of the rotational direction of the fixation roller 110.

The pressure distribution of the contact area H of the comparative example 200 of fixing apparatus, in terms of the rotational direction of the fixation roller 110, is shown in FIG. 5(*b*). The pressure peak of the contact area H of the comparative fixing apparatus 200 is at the center (mid point) of the contact area H in terms of the rotational direction of the fixation roller 110.

In comparison, in the case of the fixing apparatus 100 in this embodiment (first preferred embodiment), the pressure peak of the contact area H is in the upstream portion of the contact area H, relative to the center (mid point), in terms of the rotational direction of the fixation roller 110.

(2-6) Description of Effect of First Preferred Embodiment Upon Prevention of Scarring of Peripheral Surface of Fixation Roller by Foreign Substance, in Contact Area Next, the main reason why the peripheral surface (separation layer 114) of the fixation roller 110 becomes scarred is that foreign substances, such as sand, paper fibers, and the like, which are present in the environment in which the fixing apparatus 100 is used, enter the contact area H.

The primary cause of the damages to the peripheral surface (separation layer 114) of the fixation roller 110 is that foreign substances, such as sand, paper fiber, which are in the environment in which the fixing apparatus 100 is used, enter the contact area H.

One of the reasons why the peripheral surface of the fixation roller 110 of the fixing apparatus 100 in the first preferred embodiment is prevented from being scarred is that the fixing apparatus 100 is structured so that it is difficult for foreign substances to enter the contact area H of the fixing apparatus 100.

First, how the foreign substances enter the contact area H of the comparative fixing apparatus 200 will be described.

Figure 6:
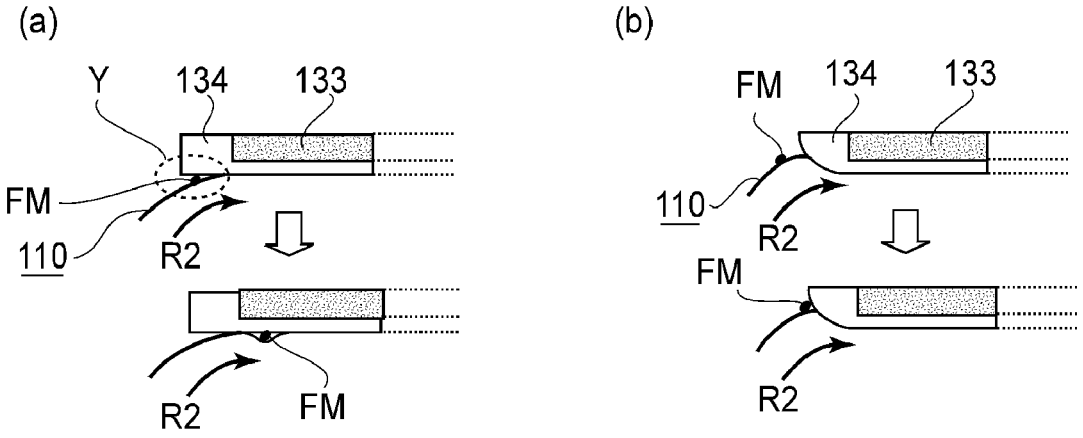
In FIG. 6, (*a*) is a schematic drawing of the entrance portion of the area of contact of the comparative example of fixing apparatus, and (*b*) is a schematic drawing of the entrance portion of the area of contact of the fixing apparatus in the first preferred embodiment of the present invention.

FIG. 6(*a*) is a schematic drawing of the entrance side of the contact area H of the comparative fixing apparatus 200. As the fixation roller 110 rotates, a foreign substance having adhered to the peripheral surface of the fixation roller 110 is carried to the entrance gap Y of the contact area H. It is possible that the foreign substance will be stopped at the entrance gap Y of the contact area H. In the case of the comparative fixing apparatus 200, however, the pressure in the entrance gap Y is low (FIG. 5(*b*)). Therefore, the foreign substance is conveyed into the contact area H. If the entrance gap Y is eliminated by aligning the upstream end J of the glass layer 114 of the heater 131 with the entrance of the contact area H, it is likely for the foreign substance to be rejected by the vertical surface of the upstream end J of the glass layer 114 of the heater 131, and therefore, the probability with which the foreign substance will enter the contact area H will be smaller. However, if the foreign substance is not rejected by the vertical surface of the upstream end J of the glass layer 114 of the heater 131, and therefore, remains on the fixation roller 110, the foreign substance enters the contact area H for the same reason as the above-described one, that is, the upstream end of the contact area H of the comparative example of fixating apparatus 200 is lower in internal pressure.

Next, how the fixing apparatus 100 in this embodiment (first preferred embodiment) reduces the amount of foreign substances entering the contact area H will be described.

FIG. 6(*b*) is a schematic drawing of the entrance side of the contact area H of the fixing apparatus 100 in the first preferred embodiment.

In the case of the fixing apparatus 100 in the first preferred embodiment, the upstream end J of the glass layer 114 of the heater 131 is within the contact area H, as described above. Therefore, the foreign substance is likely to be rejected by the curved lateral surface of the upstream end J of the glass layer 114 of the heater 131. Further, the internal pressure of the contact area H is greater in the upstream portion of the contact area H in terms of the rotational direction of the fixation roller 110, making it difficult for the foreign substance to enter the contact area H. Therefore, the fixing apparatus 100 in the first preferred embodiment is significantly smaller in the amount of foreign substances which enter the contact area H, than the comparative fixing apparatus 200.

Next, the primary effect obtainable by the fixing apparatus 100 in the first preferred embodiment, that is, the reason why the fixation roller 110 in the first preferred embodiment is less likely to be scarred even if foreign substances enter the contact area H, than the counterpart in the comparative fixing apparatus 200, will be described.

Figure 7:
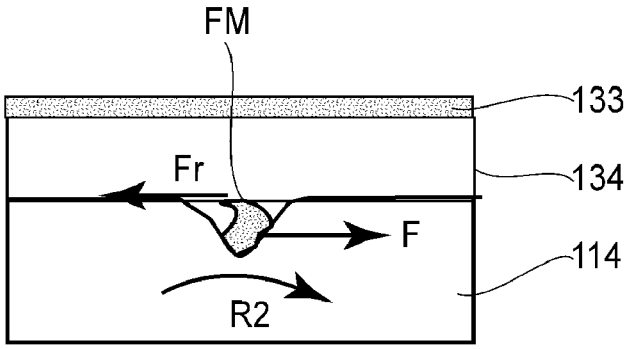
FIG. 7 is a schematic drawing for describing the force which works on the foreign substances having entered the area of contact of the fixing apparatus in the first preferred embodiment of the present invention.

First, referring to FIG. 7, the force that acts on the foreign substance having entered the contact area H will be described. As the foreign substance enters the contact area H, a force F works on the foreign substance in the same direction as the rotational direction R2 of the fixation roller 110. Then, as the foreign substance is conveyed in the above-described direction, a frictional force Fr, which is opposite in direction from the rotational direction R2 of the fixation roller 110, occurs between the foreign substance and the surface of the heater 110. If the foreign substance conveyance force F is smaller than the frictional force Fr, the foreign substance conveyance speed is less than the rotational speed of the fixation roller 110, because the foreign substance hangs up and/or makes rotational movement. This increases the difference in the moving speed between the foreign substance and the peripheral velocity of the fixation roller 110.

Figure 8:
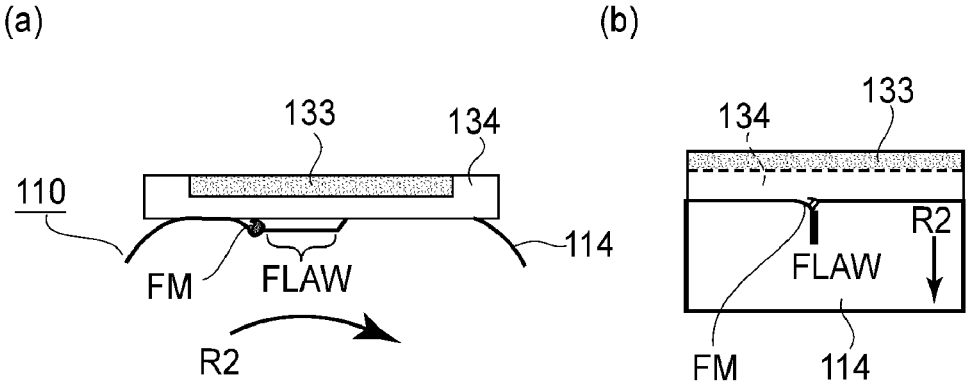
In FIG. 8, (*a*) is a schematic drawing of the fixing apparatus, in the first preferred embodiment of the present invention, in which a foreign substance is remaining trapped in the area of contact between the peripheral surface of the fixation roller, and the glass layer of the heater, and (*b*) is a schematic drawing of the foreign substance which is being conveyed out of the area of contact, and the scar which has been generated in the peripheral surface of the fixation roller.

Shown schematically in FIGS. 8(*a*) and 8(*b*) are the phenomenon that occurs when the difference between the foreign substance speed and the rotational speed of the fixation roller 110 is the largest, for example, if the foreign substance is trapped in the tiny recesses in the surface of the glass layer 134 of the heater 131, in the contact area H. FIG. 8(*a*) is a drawing for illustrating the case in which a foreign substance remains trapped between the peripheral surface of the fixation roller 110 and the glass layer 134 of the heater 131. FIG. 8(*b*) is a drawing for illustrating the foreign substance which is being conveyed to the exit of the contact area H by the rotation of the fixation roller 110, and the scars on the peripheral surface of the fixation roller 110.

Referring to FIG. 8(*a*), as the fixation roller 110 rotates while the foreign substance remains trapped in the contact area H, the foreign substance continuously shaves the peripheral surface of the fixation roller 110. Even if the speed of the foreign substance remains constant, the peripheral surface of the fixation roller 110 is shaved by the foreign substance through the same mechanism, as long as there is a substantial difference between the speed of the foreign substance and the rotational speed of the fixation roller 110.

On the other hand, even if a foreign substance enters the contact area H, the peripheral surface of the fixation roller 110 is not going to be scarred, as long as the foreign substance is conveyed at the same speed as the rotational speed of the fixation roller 110.

If the pressure applied to the heater 131 through the heater holder 137 is low, the peripheral surface of the fixation roller 110 fails to fully contact the foreign substance, and therefore, the foreign substance conveyance force F is smaller. Therefore, the difference between the foreign substance conveyance speed and the rotational speed of the fixation roller 110 is larger, and therefore, the peripheral surface of the fixation roller 110 is likely to be scarred.

Figure 9:
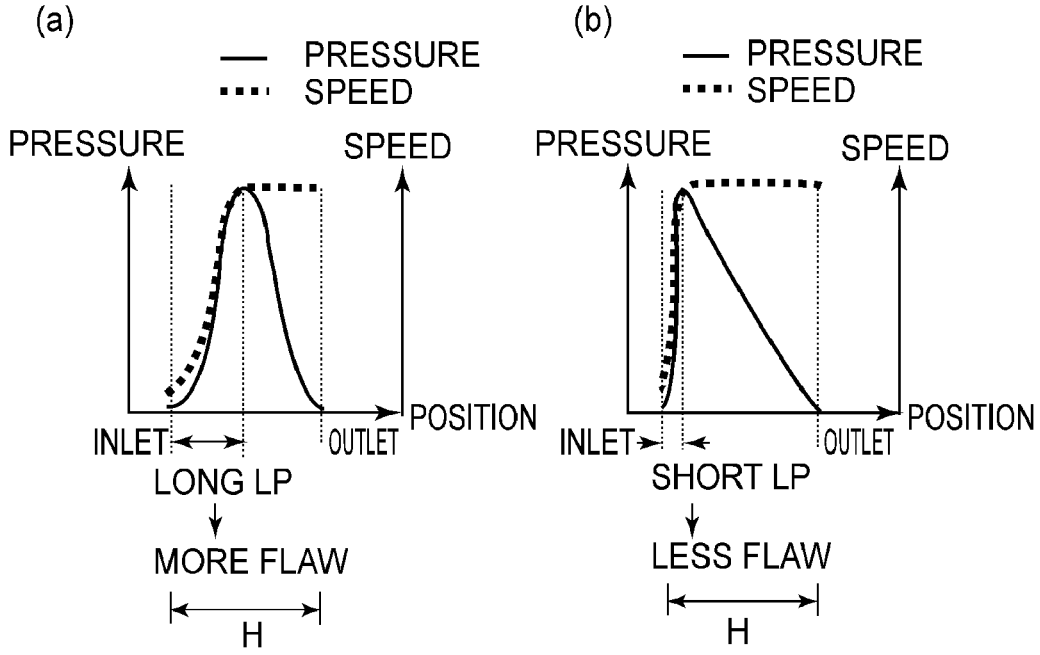
In FIG. 9, (*a*) is a diagrammatic drawing which shows the relationship between the pressure distribution of the area of contact, and the changes in the foreign substance conveyance speed, in the comparative example of fixing apparatus, and (*b*) is a diagrammatic drawing which shows the relationship between the pressure distribution of the area of contact, and the changes in the foreign substance conveyance speed, in the fixing apparatus in the first preferred embodiment.

FIG. 9(*a*) is a drawing which shows the pressure distribution in the contact area H of the comparative fixing apparatus 200, in terms of the rotational direction of the fixation roller 110, and the changes in the foreign substance conveyance speed. FIG. 9(*b*) is a drawing which shows the pressure distribution in the contact area H of the fixing apparatus 100 in the first preferred embodiment, in terms of the rotational direction of the fixation roller 110, and the changes in the foreign substance conveyance speed. In FIGS. 9(*a*) and 9(*b*), the solid line represents the pressure distribution, and the dotted line represents the changes in the foreign substance conveyance speed.

In the case of the comparative fixation apparatus 200, the position of the pressure peak is at the middle of the contact area H. Therefore, the upstream half of the contact area H, that is, the contact area portion from the upstream entrance of the contact area H to the mid point of the contact area H, is lower in internal pressure than the downstream portion of the contact area H. Therefore, in the upstream half of the contact area H, the peripheral surface of the fixation roller 110 does not fully conform in shape to the contour of the foreign substance having entered the contact area H. Then, as the foreign substance is conveyed close to the center of the contact area H, the peripheral surface of the fixation roller 110 better conforms in shape to the contour of the foreign substance. Thus, the closer to the upstream entrance of the contact area H, the greater the difference between the foreign substance conveyance speed and the rotational speed of the fixation roller 110, in the contact area H, and the closer to the center of the contact area H, the smaller the difference between the foreign substance speed and the rotational speed of the fixation roller 110 in the contact area H. Therefore, the probability with which the peripheral surface of the fixation roller 110 is scarred is greater in the upstream half of the contact area H, that is, the portion between the upstream entrance of the contact area H to the middle of the contact area H, where the internal pressure is lower.

Referring to FIG. 9(*b*), on the other hand, in the case of the fixing apparatus 100 in the first preferred embodiment, the pressure peak is in the upstream portion of the contact area H, relative to the center of the contact area H. Therefore, even if a foreign substance enters the contact area H, the peripheral surface of the fixation roller 110 is likely to conform in shape to the contour of the foreign substance, as soon as the foreign substance enters the contact area H. Therefore, the foreign substance conveyance force F will be greater. That is, in this case, even if a foreign substance enters the contact area H, the difference between the foreign substance conveyance speed and the rotation speed of the fixation roller 110 is smaller than that in the case of the comparative fixation apparatus 200. Therefore, in the case of the fixing apparatus 100, the peripheral surface of the fixation roller 100 is less likely to be scarred compared to the case of the comparative fixing apparatus 200. As the foreign substance is conveyed past the position of the pressure peak, the pressure applied to the foreign substance by the fixation roller 110 gradually decreases. However, the peripheral surface of the fixation roller 110 in the first preferred embodiment conforms better in shape to the contour of the foreign substance in the upstream half of the contact area H, than that of the fixation roller 110 of the comparative fixing apparatus 200. Therefore, once the foreign substance enters the contact area H of the fixing apparatus 100, it is likely to be conveyed through the downstream half of the contact area H at the same speed as that in the upstream half. Therefore, it is unlikely for the foreign substance to scar the peripheral surface of the fixation roller 110 while the foreign substance is conveyed through downstream half of the contact area H.

If the pressure distribution in the contact area H of a fixing apparatus is as it is in the fixing apparatus 100 in the first preferred embodiment, a foreign substance having entered the upstream half of the contact area H is conveyed through the rest of the contact area H at virtually the same speed as the rotational speed of the fixation roller 110. Therefore, even if a foreign substance enters the contact area H, the peripheral surface of the fixation roller 110 is unlikely to be scarred.

As described above, the fixing apparatus 100 in the first preferred embodiment is structured so that the upstream end J of the glass layer 114 of the heater 131 is close to the point of intersection between the line L2 and interface S. Incidentally, even if the fixing apparatus 100 is structured so that the upstream end J of the glass layer 114 is in the downstream half of the contact area H, the pressure peak is still formed in the upstream half of the contact area H. However, if the upstream end J is positioned too downstream relative to the center of the contact area H, the contact area H becomes too narrow, and therefore, the amount of heat supplied from the heater 131 to the fixation roller 110 decreases.

However, the upstream end J of the glass layer 114 of the heater 131 may be moved to the upstream portion of the contact area H, provided that the upstream end J remains within the contact area H. However, moving the upstream end J into the upstream portion of the contact area H lengthens the distance from the entrance of the contact area H to the pressure peak. Therefore, it increases the probability with which foreign substances scar the fixation roller 110. That is, it reduces the scar prevention effect.

If the heater 131 is changed in place as in the first preferred embodiment, it is possible that the heating element 133 will be placed partially outside the contact area H, although whether or not the heating element 133 is placed partially outside the contact area H depends on the pattern in which the heating element 133 was printed. If the heating element 133 is positioned partially outside the contact area H, it will be smaller in the ratio with which heat is transferred from it to the fixation roller 110. Therefore, it is desired that the heating element 133 is kept within the contact area H by reducing it in width so that the end of the glass layer 114, which is outside the contact area H remains in contact with the peripheral surface of the fixation roller 110.

In the first preferred embodiment, the upstream end J of the glass layer 14 of the heater 131, in terms of the rotational direction of the fixation roller 110, is in contact with the peripheral surface of the fixation roller 110. Therefore, if a pressure FA1 applied to the heater 131 is greater than a certain value, it is possible that the peripheral surface of the fixation roller 110 will be scarred by the upstream end J. Therefore, it is desired that the pressure FA1 is set so that the peak value of the internal pressure of the contact area H remains no higher than roughly 9.8 N (1.0 kgf/cm$^2$).

In the first preferred embodiment, PFA alone was used as the material for the separation layer 114 of the fixation roller 110. However, filler, such as silicon carbide or graphite, may be added to PFA. Mixing filler into PFA increases the conductivity with which heat is transmitted from the heater 131 to the fixation roller 110, and also, improves the separation layer 114 in the resistance to frictional wear. Further, it was confirmed by the inventors of the present invention that mixing filler into PFA made it easier for foreign substances having entered the contact area H, to be conveyed through the contact area H.

The fixing apparatus 100 in the first preferred embodiment is structured so that the pressure peak in the contact area H formed by the glass layer 114 of the heater 131 and the separation layer 114 of the fixation roller 110, is in the upstream half of the contact area H, in terms of the rotational direction of the fixation roller 110. Therefore, it is possible to prevent the separation layer 114 of the fixation roller 110 from being scarred in the contact area H by foreign substances.

Embodiment 2

Next, another example of fixing apparatus in accordance with the present invention will be described.

The members, portions, etc., of the fixing apparatus in the second preferred embodiment of the present invention, which are the same as the counterparts in the fixing apparatus in the first preferred embodiment of the present invention, will be given the same reference characters as those given to the counterparts, and will not be described, and so will be those of the fixing apparatuses in third, fourth, and fifth embodiments of the present invention.

Figure 10:
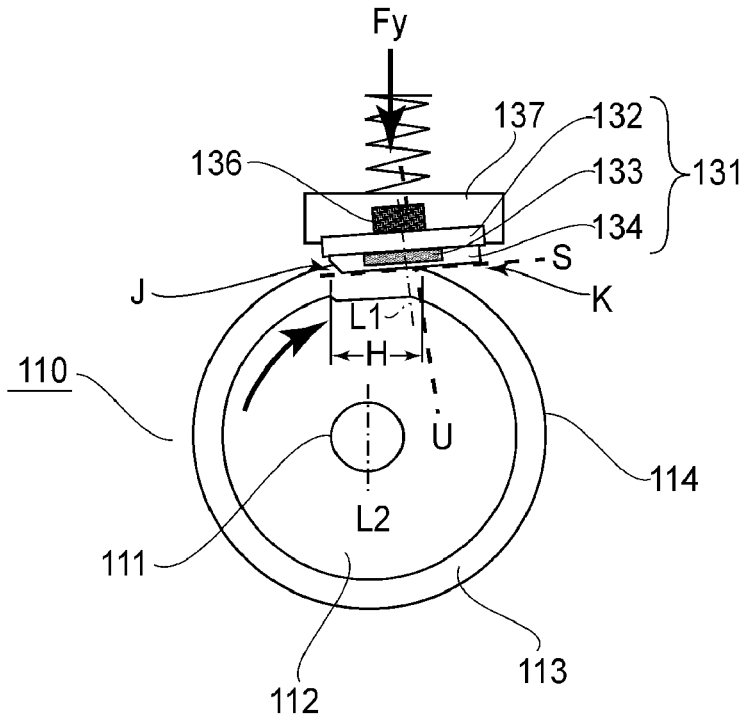
FIG. 10 is a schematic sectional drawing of the combination of the fixation roller and the heater unit of the apparatus in the second preferred embodiment of the present invention, and is for describing the area of contact between the fixation roller and heater unit.

FIG. 10 is a drawing for describing the contact area H of the fixing apparatus 100 in the second preferred embodiment of the present invention. It is a cross-sectional drawing of the combination of the fixation roller 110 and heater unit 130 of the fixing apparatus 100.

The fixing apparatus 100 in the second preferred embodiment is the same in structure as the fixing apparatus 100 in the first preferred embodiment, except that the pressure peak of the contact area H of the fixing apparatus 100 of the second preferred embodiment is placed in the upstream half of the contact area H in terms of the rotational direction of the fixation roller 110 by tilting the heater 131 of the fixing apparatus 100 in the second preferred embodiment, relative to the fixation roller 110 of the fixing apparatus 100.

The heater 131 held to the heater holder 137 is kept pressured by the compression springs 138 toward the center line L2 of the rotational shaft of the fixation roller 110, through the heater holder 137. Hereafter, the direction in which the heater 131 is kept pressured by the compression springs 131 will be referred to as a direction Fy.

In the second preferred embodiment, the heater holder 137 was processed so that the surface of the heater holder 137, to which the heater 131 was to be held, was tilted so that the normal line U relative to the interface S between the heater 131 and fixation roller 110 did not become parallel to the direction Fy. Therefore, the heating surface of the heater 131 remains tilted relative to the fixation roller 110.

More specifically, the heater 110 is tilted so that the upstream end of the substrate 132 of the heater 131 (upstream end J of glass layer 114), in terms of the rotational direction of the fixation roller 110, is closer to the rotational axis of the fixation roller 110 than the downstream end of the substrate 132 (downstream end K of glass layer 114) of the heater 131. Further, the upstream end (upstream end J of glass layer 14) of the substrate 132 of the heater 131, in terms of the rotational direction of the fixation roller 110, is within the contact area H. Therefore, the closer, in the contact area H, to the upstream end J of the glass layer 134 of the heater 131 in terms of the rotational direction of the fixation roller 110, the greater the distance by which the glass layer 134 of the heater 131 compresses the fixation roller 110. Therefore, the point of pressure peak coincides with the position of the upstream end J of the glass layer 134 of the heater 131.

In the case of the fixing apparatus 100 in the second preferred embodiment, the pressure peak of the contact area H was placed in the upstream half of the heating nip, by increasing the distance, by which the upstream end J of the glass layer 134 of the heater 131 compresses the fixation roller 110 in the upstream half of the heating nip, by tilting the heater 131.

The pressure distribution obtained in the contact area H of the fixing apparatus 100 in the second preferred embodiment is similar to the one shown in FIG. 5(*a*). Therefore, the speed at which a foreign substance is conveyed through the upstream half of the heating nip becomes virtually the same as the rotational speed of the fixation roller 110, because of the mechanism which was described in detail regarding the first preferred embodiment. Therefore, even if foreign matter enter the contact area H, it is unlikely for the peripheral surface (separation layer 114) of the fixation roller 110 to be scarred by the foreign substance.

Further, in the case of the second preferred embodiment, the distance by which the upstream end J of the glass layer 134 compresses the fixation roller 110 is increased by tilting the heater 131. Therefore, the entrance of foreign substances into the contact area H is prevented by the surface of the upstream end J of the glass layer 134. Further, in the case of the second preferred embodiment, it is more difficult for foreign substances to enter the contact area H than in the case of the first preferred embodiment.

Embodiment 3

Next, another preferred embodiment of the present invention will be described.

Figure 11:
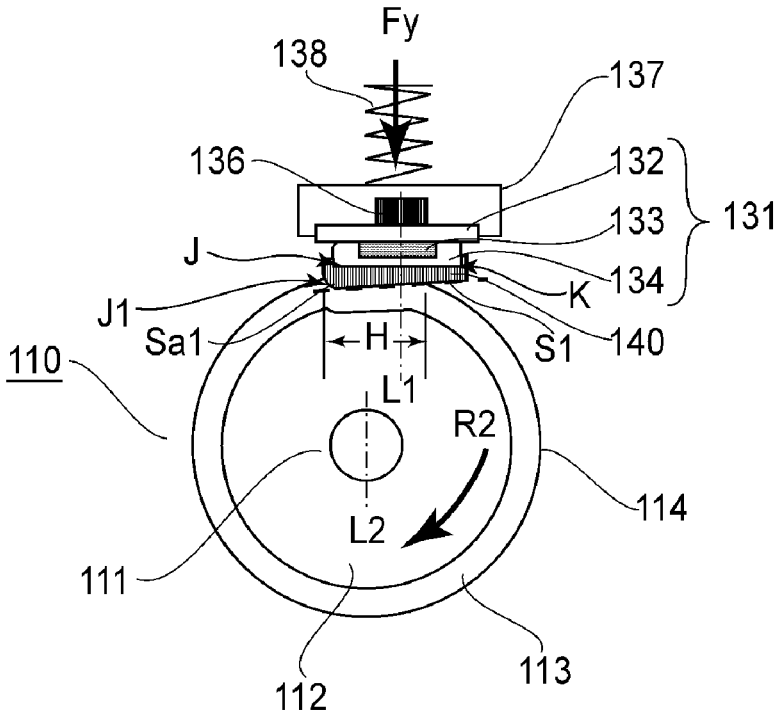
FIG. 11 is a schematic sectional drawing of the combination of the fixation roller and the heater unit of the apparatus in the third preferred embodiment of the present invention, and is for describing the area of contact between the fixation roller and the heater unit.

FIG. 11 is a drawing for describing the contact area H of the fixing apparatus 100 in the third preferred embodiment of the present invention. It is a schematic cross-sectional drawing of the combination of the fixation roller 110 and heater unit 130 of the fixing apparatus 100.

The fixing apparatus 100 in the third preferred embodiment is the same in structure as the fixing apparatus 100 in the first preferred embodiment, except that it has a slippery member 140 between the heater 131 and fixation roller 110. Thus, the contact area H of this fixing apparatus 100 is the interface between this slippery member 140 and the peripheral surface of the fixation roller 110, the pressure peak of the contact area H is in the upstream half of the contact area H. Heat is conducted from the heater 131 to the peripheral surface of the fixation roller 110 through the slippery member 140.

Placing the slippery member 140 between the heater 131 and fixation roller 110 reduces the friction between the heater 131 and fixation roller 110, and therefore, reduces the amount of torque necessary to rotate the fixation roller 110. Therefore, it makes it possible to change the contact area H in shape according to the desire of a user, without changing the heater 131 in shape, which is one of the merits of this setup.

Referring to FIG. 11, the slippery member 140 is shaped so that its cross-section is roughly in the form of a letter U. It is attached to the heater 131 so that it covers the surface of the glass layer 134, which is facing the fixation roller 110, and the upstream and downstream surfaces J and K of the glass layer 134. The slippery member 140 in the third preferred embodiment is made of aluminum. The material for the slippery member 140 does not need to be limited to aluminum; it may be copper or the like, which is high in thermal conductivity.

In order to reduce the friction between the slippery member 140 and fixation roller 110, and also, to prevent the offset toner from adhering to the slippery member 140, a protective layer (unshown) is formed on the surface of the slippery member 140, of PTFE, which is excellent in slipperiness and heat resistant. From the standpoint of preventing the protective layer from interfering with the heat conduction from the slippery member 140 to the peripheral surface of the fixation roller 110, the protective layer is desired to be thin. Besides, if the protective layer is thick, there may occur such a problem that the foreign substances having entered the contact area H get stuck in the protective layer. Therefore, the slippery member 140 was coated with PTFE to a thickness which was in a range in which the surface of the slippery member 140, which was coated with PTFE, was higher in micro-hardness (surface hardness) than that of the peripheral surface of the fixation roller 110. In consideration of the matters described above, the thickness to which the protective layer is coated is desired to be in a range of 1-50 μm.

For the purpose of improving the efficiency with which heat is transmitted from the heater 131 to the slippery member 140, the surface of the slippery member 140, which contacts the heater 131, was coated with heat resistant silicon grease.

In terms of the structural arrangement for creating the pressure peak in the upstream half of the contact area H, the fixing apparatus 100 in the third preferred embodiment is the same as the fixing apparatus 100 in the second preferred embodiment. The structural difference of the fixing apparatus 100 in the third preferred embodiment from the fixing apparatus 100 in the second preferred embodiment is that in the case of the fixing apparatus 100 in the third embodiment, the surface of the slippery member 140, which is in contact with the fixation roller 110, is tilted so that the upstream edge of the surface of the slippery member 140 is closer to the axial line of the fixation roller 110 than the downstream edge of the surface of the slippery member 140; the upstream portion of the slippery member 140 compresses the fixation roller 110 more than the downstream portion of the slippery member 140. With this structural arrangement, the pressure peak of the contact area H is created in the upstream half of the contact area H. In order to prevent the this slippery member 140 from scarring the peripheral surface of the fixation roller 110, this slippery member 140 was polished across its upstream end portion J1, which corresponds to the upstream end J of the glass layer 134, to create a curved surface Sa1 which extends from the upstream end J1 to the entrance of the contact area H. It is desired that the peak value of the internal pressure generated in the contact area H by the pressure from the compression springs 138 is roughly 9.8 N (1.0 kgf/cm$^2$).

Embodiment 4

Next, another preferred embodiment will be described.

Figure 12:
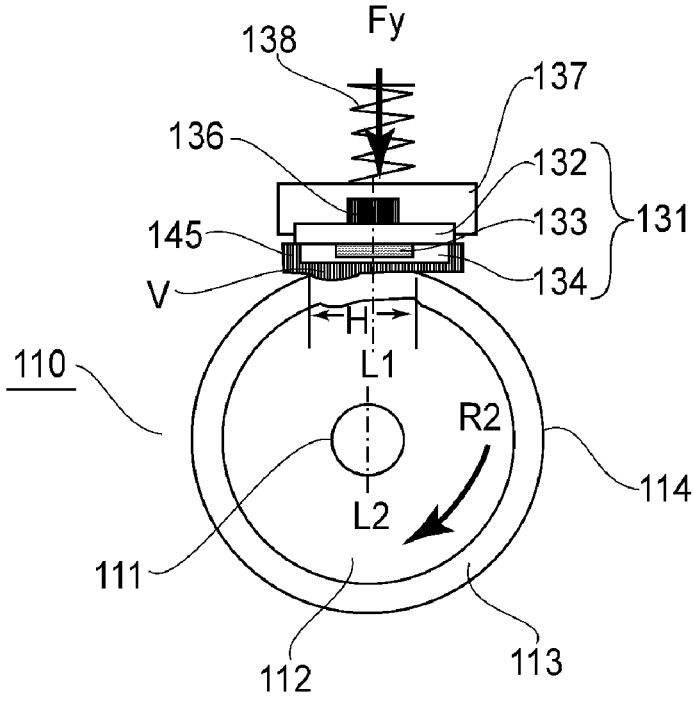
FIG. 12 is a schematic sectional drawing of the combination of the fixation roller and the heater unit of the apparatus in the fourth preferred embodiment of the present invention, and is for describing the area of contact between the fixation roller and the heater unit.

FIG. 12 is a drawing for illustrating the contact area H of the fixing apparatus 100 in the fourth preferred embodiment of the present invention. It is a schematic cross-sectional drawing of the combination of the fixation roller 110 and heater unit 130 of the fixing apparatus 100.

The fixing apparatus 100 in the fourth preferred embodiment has a slippery member 145 between the heater 131 and fixation roller 110. It is the same in structure as the fixing apparatus 100 in the third preferred embodiment, except that its slippery member 145 is different in form from the slippery member 140 in the third preferred embodiment.

In the case of the fixing apparatus 100 in the fourth preferred embodiment, the widthwise ends of the slippery member 145 are outside the contact area H. In order to place the pressure peak in the upstream half of the contact area H, the slippery member 145 was shaped so that its portion V bulged inward of the fixation roller 110. That is, the slippery member 145 was shaped so that the portion V of the slippery member 145 compresses the fixation roller 110 more than the other portions of the slippery member 145. Therefore, the pressure peak is in the upstream half of the contact area H.

Also in the case of the fixing apparatus 100 in the fourth preferred embodiment, aluminum, which is high in thermal conductivity, was used as the material for the slippery member 145, as aluminum was used as the material for the slippery member 140 in the third preferred embodiment. In the case of a slippery member, such as the slippery member 145 of the fixing apparatus 100 in the fourth preferred embodiment, which was processed so that its upstream half had a bulge, if the bulge is sharply angled in cross-section, it is highly possible that the peripheral surface of the fixation roller 110 will be scarred by the bulge.

Therefore, in order to prevent the peripheral surface of the fixation roller 110 from being scarred, the slippery member 145 was processed so that the upstream end of its bulge portion became smooth to make the heating nip smooth in shape. Further, in order not to create, in the contact area H, a portion, the upstream side of which is significantly higher in pressure than its downstream side, the downstream end of the bulge portion was also processed so that the downstream portion of the heating nip became smooth in shape, for the following reason. That is, if the contact area H has a portion, the upstream side of which is significantly higher in pressure than the downstream side, it is possible that foreign substances will scar the peripheral surface of the fixation roller 110 by hanging up in the portion.

Also in the case of the fixing apparatus 100 in the fourth preferred embodiment, a protective layer may be formed of a slippery and heat resistant material (PTFE), on the surface of the slippery member 145, which faces the fixation roller 110, as it was in the case of the fixing apparatus 100 in the third preferred embodiment.

As described above, the widthwise ends of the slippery member 145 are outside the contact area H. However, the slippery member 145 was shaped so that it had the bulge V which was in the upstream half of the heating hip. Therefore, the pressure peak was created in the upstream half of the contact area H. Therefore, it was possible to prevent the problem that the peripheral surface of the fixation roller 110 is scarred by foreign substance, through the same mechanism as the mechanism described regarding the preceding preferred embodiments.

In the case of the fourth preferred embodiment, the slippery member 145 was provided with the bulge V. However, the same effect can be obtained by providing the glass layer 134 of the heater 131 with a bulge similar to the bulge V of the slippery member 145, instead of employing the slippery member 145.

Embodiment 5

Next, another preferred embodiment of the present invention will be described.

Figure 13:
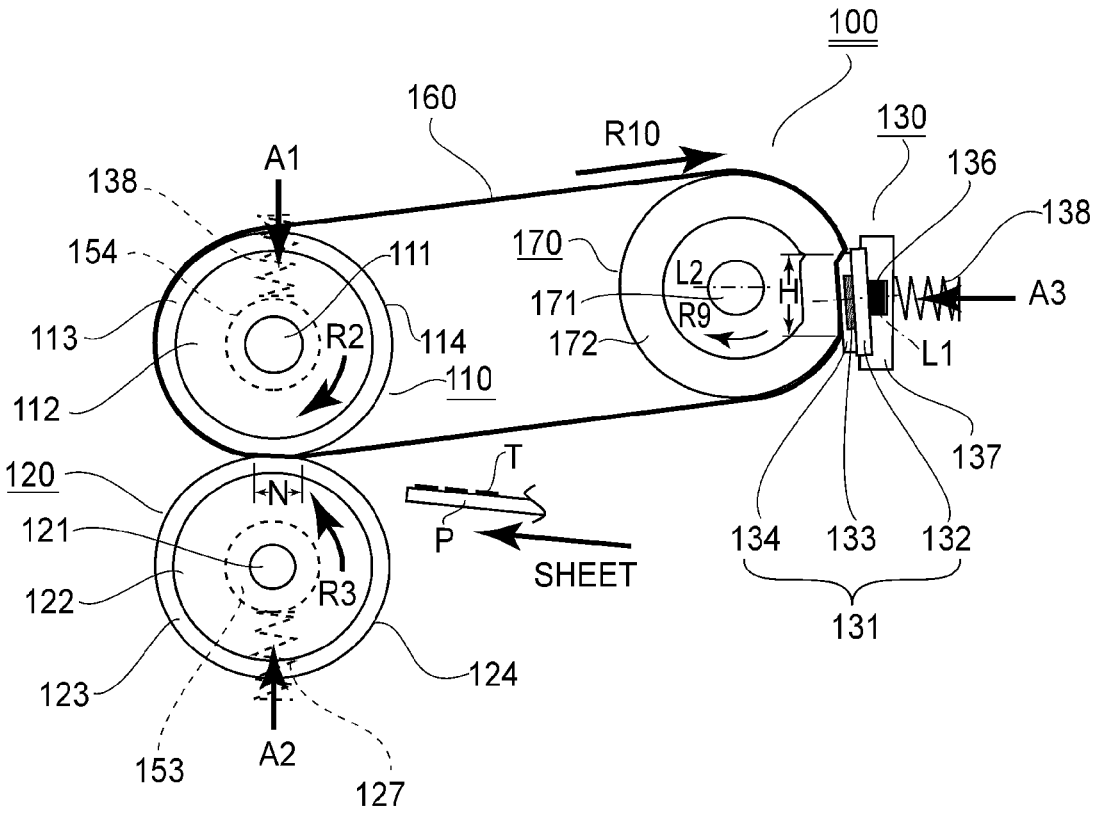
FIG. 13 is a schematic sectional drawing of the fixing apparatus in the fifth preferred embodiment of the present invention.

FIG. 13 is a schematic cross-sectional drawing of the fixing apparatus 100 in the fifth preferred embodiment of the present invention.

The fixing apparatus 100 in the fifth preferred embodiment uses an endless belt 160 (which hereafter will be referred to as fixation belt) as one of the rotational members. It is also has a fixation roller 110, a tension roller 170, and a heater unit 130. It is structured so that the fixation belt 160 is wrapped around the fixation roller 110 and tension roller 170, and is heated by the heater unit 130. That is, the belt 160 is suspended and stretched by multiple rollers.

The tension roller 170 is made up of a metallic core 171 and an elastic layer 172. The metallic core 171 is in the form of a round shaft. The elastic layer 172 is formed of rubber sponge made by foaming silicone rubber, foamy rubber made by dispersing hollow particles, as filler, in silicone rubber, or the like material. It is formed in the shape of a roller, around the metallic core 171. In terms of the recording medium conveyance direction, the tension roller 170 is on the downstream side of the fixation nip N, which will be described later. It is on the right-hand side (of the fixation roller 110 in the drawing, and is positioned slightly higher than the fixation roller 110. It is rotatably held by the pair of lateral plates 151 of the apparatus frame 150, by the lengthwise ends of its metallic core 161, with the presence of bearings 152 between the lengthwise ends of the metallic core 161 and lateral plates 151, one for one.

As the fixation roller 110 is rotated, the fixation belt 160, which is stretched around the fixation roller 110 and tension roller 170, follows the rotation of the fixation roller 110, circularly moving thereby in the direction indicated by an arrow mark R10.

The pressure roller 120 and the fixation roller 110 form a fixation nip N, with the fixation belt 170 remaining pinched between the two rollers 120 and 110. Thus, as the fixation belt 160 circularly moves, the pressure roller 120 follows the circular movement of the fixation belt 160, rotating thereby in the direction indicated by an arrow mark R3.

The fixing apparatus 100 in the fifth preferred embodiment of the present invention is structured so that in order to efficiently heat the fixation belt 160, the fixation belt 160 is heated from the outward surface of the fixation belt 160 in terms of the loop of the fixation belt 160, as are the peripheral surface of each of the fixation rollers in the above described first to fourth preferred embodiments. In order to heat the fixation belt 160 from the outward surface of the fixation belt 160, the heater of the heater unit 130 is placed in contact with the portion of the fixation belt 160, which is in contact with the tension roller 170, forming the contact area H between the outward surface of the fixation belt 160, and the heater 131. The heater 131 of the heater unit 130 is under the pressure applied by the compression springs 138 in the direction indicated by an arrow mark A3 through the heater holder 137. The amount of force applied to the heater 131 by the compression springs 138 is 0.2 N.

Here, referring to FIG. 14, the laminar structure of the fixation belt 160 will be described.

Figure 14:
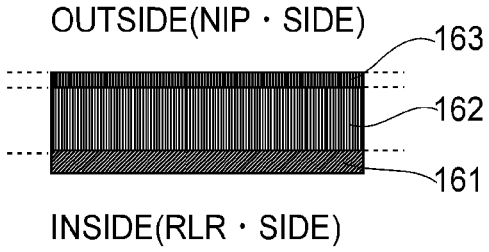
FIG. 14 is a schematic sectional drawing of the fixation belt of the fixing apparatus in the fifth preferred embodiment, and shows the laminar structure of the fixation belt.

FIG. 14 is a schematic sectional drawing of a part of the fixation belt 160, and is for showing the laminar structure of the fixation belt 160.

The fixation belt 160 has: an endless substrate layer 161 formed of polyimide resin, for example; a primer layer (unshown) coated on the outward surface of the substrate layer 161; an elastic layer 162 formed on the primer layer; and a separation layer 163 formed of fluorinated resin, on the outward surface of the elastic layer 162.

As the material for the elastic layer 162, a substance, such as silicone rubber, fluorinate rubber, fluorinated silicone rubber, etc., which is superior in heat resistance and thermal conductivity, is used. In the fifth preferred embodiment, solid silicone rubber, the thermal conductivity of which is in a range of 0.25-0.29 W/m·K was used as the material for the elastic layer 162.

As the material for the separation layer 163, perfluoroalkoxy resin (PFA) was used as it was used for the separation layer of the fixation roller 110.

In the case of the fixing apparatus 100 in the fifth preferred embodiment, a recording medium sheet P, which is bearing an unfixed color toner image T, is introduced into the fixation nip N from the direction indicated by an arrow mark. As the recording medium sheet P is introduced into the fixation nip N, it is conveyed through the fixation nip N while remaining pinched by the surface of the fixation belt 160 and the surface of the pressure roller 120. While the recording medium sheet P is conveyed through the fixation nip N, the heat from the surface of the fixation belt 160 which is being heated by the heater 131, and the pressure in the fixation nip N, are applied to the recording medium sheet P. Thus, the toner image T on the recording medium sheet P is thermally fixed to the surface of the recording medium sheet P by the heat and pressure.

In the case of the fixing apparatus 100 in the fifth preferred embodiment, in order to make it possible to prevent the surface (separation layer 163) of the fixation belt 160 from being scarred by foreign substances in the contact area H, the pressure peak of the contact area H is formed in the upstream half of the contact area H. The structural arrangement for forming the pressure peak in the upstream half of the contact area H in the fixing apparatus 100 in this embodiment is similar to that in the second preferred embodiment. That is, the pressure peak is formed in the upstream half of the contact area H, by making the amount by which the tension roller 170 is compressed by the upstream portion of the heater 131, larger than the amount by which the downstream portion of the tension roller 170 is compressed by the heater 131, by tiling the heater 131 so that the upstream end of the heater 131 becomes closer to the fixation belt 160 than the downstream end of the heater 131. Therefore, even if a foreign substance enters the contact area H, the speed with which the foreign substance is conveyed through the contact area H is made roughly the same as the rotational speed of the fixation belt 160 in the contact area H, in the upstream portion of the contact area H, and therefore, it is unlikely for the peripheral surface of the outward surface (separation layer 163) of the fixation belt 160 to be scarred.

Further, in the case of the fixing apparatus 100 in the fifth preferred embodiment, the structural arrangement that rotates the fixation roller 110 as the driver roller was employed. However, a structural arrangement that rotates the tension roller 133 or pressure roller 111 as the driver roller may be employed.

[Miscellanies]

In the first, second, and third preferred embodiments, the glass layer 134 of the heater 131 was in contact with the peripheral surface of the fixation roller 110. Thus, the surface of the glass layer 134, which faces the fixation roller 110, may be coated with a slippery substance, such as PTFE or the like. Further, the material for the slippery member 140 does not need to be limited to metals. For example, a sheet of fluorinated resin, such as PFA, may be used as the material for the slippery member 140. However, if the slippery layer formed on the glass layer 134 by coating the glass layer 134 with PTFE, or covering the glass layer 134 with a sheet of fluorinated resin, is thicker than a certain value, it is highly possible that the foreign substance having entered the contact area H will be trapped in the contact area H by being embedded in the slippery member 140 of the heater 131.

If a foreign substance is trapped in the contact area H, it is unlikely for the above-described effects of the preceding preferred embodiments to be realized. Therefore, if it is decided to coat the glass layer 134 of the heater 131 with PTFE, or provide the heater 131 with slippery member 140 formed of a sheet of fluorinated resin, it has to ensured that the thickness of the PTFE or sheet of fluorinated sheet is within a range in which the hardness of the surface layer of the heater 131 is greater than that of the fixation roller 110.

Further, the thicker the PTFE layer or the sheet of fluorinated resin, the slower the speed of heat conduction from the heater 131 to the fixation roller 110. Thus, in consideration of the problems described above, the thickness of the PTFE layer or sheet of fluorinated resin is desired to be no more than 50 μm.

Also in the above-described preferred embodiments, the pressure roller was used as the backup member for forming the fixation nip N in coordination with the fixation roller 110. However, the backup member does not need to be in the form of a roller. For example, a piece of pad or the like may be employed as the backup member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 304022/2008 filed Nov. 28, 2008, which is hereby incorporated by reference.

What is claimed is:

1. An image heating apparatus comprising:

a rotatable member;

a heater contactable to a surface of said rotatable member to heat said rotatable member; and a back-up member cooperative with said rotatable member to form a nip for nipping and feeding a recording material carrying an image, wherein a position of a peak in a pressure distribution with respect to a rotational direction of said rotatable member is upstream, with respect to the rotational direction, of a central portion of a contact region between said rotatable member and said heater with respect to the rotational direction.

2. An apparatus according to claim 1, wherein said heater includes a ceramic substrate and a heat generating resistor provided on said ceramic substrate.

3. An apparatus according to claim 1, wherein said rotatable member is a roller having an elastic layer around a metal core.

4. An apparatus according to claim 3, wherein said roller has a heat storage layer provided around said elastic layer, wherein the thermal conductivity of said elastic layer is no higher than 0.15 W/m·k and the specific gravity of said elastic layer is no higher than 0.85, and the thermal conductivity of said heat storage layer is 0.50 W/m·k-1.60 W/m·k and the specific gravity of said heat storage layer is 1.05-1.30.

5. An apparatus according to claim 4, wherein said roller has a separation layer which is provided around said heat storage layer, and the material of which said separation layer is composed is a fluorinated resin.

6. An apparatus according to claim 5, wherein said separation layer contains silicon carbide or graphite.

7. An apparatus according to claim 5, wherein said roller is formed so that its surface hardness is in a range of 40°-45° in the Asker C scale, under a load of 4.9 N.

8. An apparatus according to claim 3, wherein said heater is disposed such that in a contact area between said heater and said roller, a line L1 which is perpendicular to a contact plane between said heater and said roller and which passes through a widthwise center of said heater is downstream, with respect to the rotational direction of said roller, of a line L2 which is parallel with the widthwise center line L1 and which passes through said metal core.

9. An apparatus according to claim 8, wherein a portion of said heater at an entrance to the contact area is a curved surface.

10. An apparatus according to claim 1, wherein said rotatable member is an endless belt stretched around a plurality of rollers, and one of the rollers and said back-up member sandwiches said endless belt to form said nip.

11. An apparatus according to claim 1, further comprising a sliding member interposed between said heater and said rotatable member.

12. An apparatus according to claim 11, wherein a micro hardness of a surface of said sliding member is higher than that of a surface of said rotatable member.

13. An apparatus according to claim 11, wherein a surface of said sliding member which is in contact with said rotatable member is tilted so that the upstream edge of the surface of said sliding member, upstream with respect to the rotational direction, is closer to an axial line of said rotatable member than the downstream edge of the surface of said sliding member, downstream with respect to the rotational direction.

14. An apparatus according to claim 11, wherein a surface of said sliding member which is in contact with said rotatable member has a bulge portion configured to create the peak in the pressure distribution.

15. An apparatus according to claim 1, wherein the peak value in the pressure distribution is no higher than 9.8 N.

16. An apparatus according to claim 1, wherein said heater is kept under pressure by a compression spring in a pressing direction toward said rotatable member, and wherein said heater is tilted so that a normal line relative to an interface between said heater and said rotatable member does not become parallel to the pressing direction by said compression spring.

* * * * *